US009455484B2

(12) United States Patent
Miraftab

(10) Patent No.: US 9,455,484 B2
(45) Date of Patent: Sep. 27, 2016

(54) WIDEBAND ELECTRONICALLY TUNABLE CAVITY FILTERS

(71) Applicant: Huawei Technologies Co., Ltd., Shenzhen (CN)

(72) Inventor: Vahid Miraftab, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 78 days.

(21) Appl. No.: 14/452,407

(22) Filed: Aug. 5, 2014

(65) Prior Publication Data

US 2015/0116057 A1 Apr. 30, 2015

Related U.S. Application Data

(60) Provisional application No. 61/895,807, filed on Oct. 25, 2013.

(51) Int. Cl.

| | |
|---|---|
| ***H01P 7/06*** | (2006.01) |
| ***H01P 1/207*** | (2006.01) |
| ***H01P 7/04*** | (2006.01) |

(52) U.S. Cl.

CPC ..... *H01P 1/207* (2013.01); *H01P 7/04* (2013.01); *H01P 7/06* (2013.01)

(58) Field of Classification Search

CPC . H01P 1/205–1/211; H01P 7/04; H01P 7/06; H01P 7/065

USPC ..... 333/219, 222–224, 227, 231, 232, 235

See application file for complete search history.

(56) References Cited

U.S. PATENT DOCUMENTS

| | | | | |
|---|---|---|---|---|
| 5,329,687 | A | 7/1994 | Scott et al. | |
| 6,097,263 | A * | 8/2000 | Mueller | H01P 1/20336 333/17.1 |
| 6,617,945 | B2 * | 9/2003 | Lotz | H01P 7/04 333/101 |
| 7,327,210 | B2 * | 2/2008 | Blair | H01P 7/04 333/202 |
| 7,352,264 | B2 * | 4/2008 | Schwab | H01P 1/2053 333/203 |
| 7,982,560 | B2 * | 7/2011 | Hesselbarth | H01P 1/20327 333/204 |
| 2006/0152306 | A1 | 7/2006 | Ito et al. | |
| 2008/0067948 | A1 | 3/2008 | Hesselbarth | |

(Continued)

FOREIGN PATENT DOCUMENTS

| | | | |
|---|---|---|---|
| CN | 1754281 | A | 3/2006 |
| CN | 101315999 | A | 12/2008 |
| CN | 101425788 | A | 5/2009 |

(Continued)

OTHER PUBLICATIONS

Siamak Fouladi, et al., "Combline Tunable Bandpass Filter Using RF-MEMS Switched Capacitor Bank", 2012 IEEE, 3 pages.

(Continued)

*Primary Examiner* — Dean Takaoka
*Assistant Examiner* — Alan Wong
(74) *Attorney, Agent, or Firm* — Slater Matsil, LLP

(57) ABSTRACT

An apparatus to filter electromagnetic waves includes a cavity and one or more tuning circuits. The cavity is configured to receive the electromagnetic waves and has a resonant frequency. The one or more tuning circuits are disposed proximate to or in the cavity. The one or more tuning circuits and the cavity are configured to filter the electromagnetic waves and the resonant frequency of the cavity is based on the one or more tuning circuits.

30 Claims, 15 Drawing Sheets

(56) References Cited

U.S. PATENT DOCUMENTS

| | | | | |
|---|---|---|---|---|
| 2009/0128263 | A1 | 5/2009 | Hesselbarth | |
| 2013/0335173 | A1* | 12/2013 | Peroulis | H01P 7/06 333/231 |

FOREIGN PATENT DOCUMENTS

| | | | |
|---|---|---|---|
| CN | 101517822 | A | 8/2009 |
| WO | WO 2010/063307 | A1 | 6/2010 |

OTHER PUBLICATIONS

Aliakbar Ghadiri, et al., "High-Quality-Factor Active Capacitors for Millimeter-Wave Applications", IEEE Transactions on Microwave Theory and Techniques, vol. 60, No. 12, Dec. 2012, p. 3710-3718.

Winter Dong Yan, et al., "Tunable Dielectric Resonator Bandpass Filter With Embedded MEMS Tuning Elements", IEEE Transactions on Microwave Theory and Techniques, vol. 55, No. 1, Jan. 2007, p. 154-160.

* cited by examiner

WIDEBAND ELECTRONICALLY TUNABLE CAVITY FILTERS

PRIORITY

The present application claims priority to U.S. Provisional Application No. 61/895,807, filed Oct. 25, 2013, titled "WIDEBAND ELECTRONICALLY TUNABLE CAVITY FILTERS," which is incorporated herein by reference.

TECHNICAL FIELD

The present application relates generally to cavity filters, and more specifically, to tunable cavity filters.

BACKGROUND

Cavity filters may include a cavity resonator that is used to filter electromagnetic waves. The cavity resonator includes a cavity, which is a waveguide blocked at both ends so that electromagnetic waves trapped within the resonator reflect back and forth between the two ends with specific characteristics, including a resonant frequency, that are based on the dimensions of the cavity.

Cavity filters can be electronically tunable, e.g., via the use of microelectromechanical system (MEMS) switches. However, electronically tunable cavity filters lack wideband frequency tunability, have a very low quality factor (Q), and do not maintain uniform Q over the frequency tuning range.

SUMMARY

An apparatus to filter electromagnetic waves includes a cavity and one or more tuning circuits. The cavity is configured to receive the electromagnetic waves and has a resonant frequency. The one or more tuning circuits are disposed proximate to the cavity. The one or more tuning circuits and the cavity are configured to filter the electromagnetic waves, and the resonant frequency of the cavity is based on the one or more tuning circuits.

A method of a tunable cavity filter is provided. The method includes receiving electromagnetic waves in a cavity of the tunable cavity filter. The method also includes filtering the electromagnetic waves via one or more tuning circuits and the cavity. The one or more tuning circuits are disposed proximate to the cavity of the tunable cavity filter, and the cavity has a resonant frequency based on the one or more tuning circuits.

A printed circuit board (PCB) configured to filter electromagnetic waves in a cavity, the PCB including one or more tuning circuits. The one or more tuning circuits are configured to be disposed proximate or in a cavity. The one or more tuning circuits and the cavity are configured to filter electromagnetic waves. The cavity is configured to receive the electromagnetic waves and has a resonant frequency. The resonant frequency of the cavity is based on the one or more tuning circuits.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged filter.

The present disclosure provides cavity resonators that make up cavity filters with electronic tuning capability. Certain embodiments of the cavity resonator include a printed circuit board (PCB) that is placed parallel to an axis of the cavity resonator, i.e., the PCB is placed vertically within the cavity of the cavity resonator. The placement of the PCB is alongside the electromagnetic (EM) field that resonates within the cavity and offers a wide tuning range.

Certain embodiments of the present disclosure include high quality (Q) structures and also include circuits that provide negative equivalent series resistance (ESR). These structures and circuits are integrated with and proximate to the cavity to offer enhanced Q factor using different configurations for tunability. Negative ESR along with negative capacitance or inductance can be implemented for Q compensation over frequency range and include switches and varactors that use different active technologies via transistors.

Certain embodiments of the present disclosure include cavity filters with a high Q cavity resonator and one or more tuning circuits combined with one or more lossy circuits for Q compensation. The one or more lossy circuits include MEMS switches. Filtering of EM waves with the cavity filter is electronically tunable via the MEMS switches and/or one or more varactors.

Certain embodiments of the present disclosure include miniature cavity structures and filters with enhanced Q and electronic tunability. The cavity structures and filters can be integrated into multilayer technology such as substrate integrated waveguide (SIW) for higher frequency applications, including millimeter wave (mmWave) applications. Embodiments according to the present disclosure provide filter and transfer functions for EM waves with frequencies that include frequencies from 300 megahertz (MHz) to 300 gigahertz (GHz). Embodiments according to the present invention can be configured as a coaxial resonator, a waveguide resonator, a dielectric resonator, an SIW resonator, and a stepped impedance resonator (SIR).

Figure 1A:
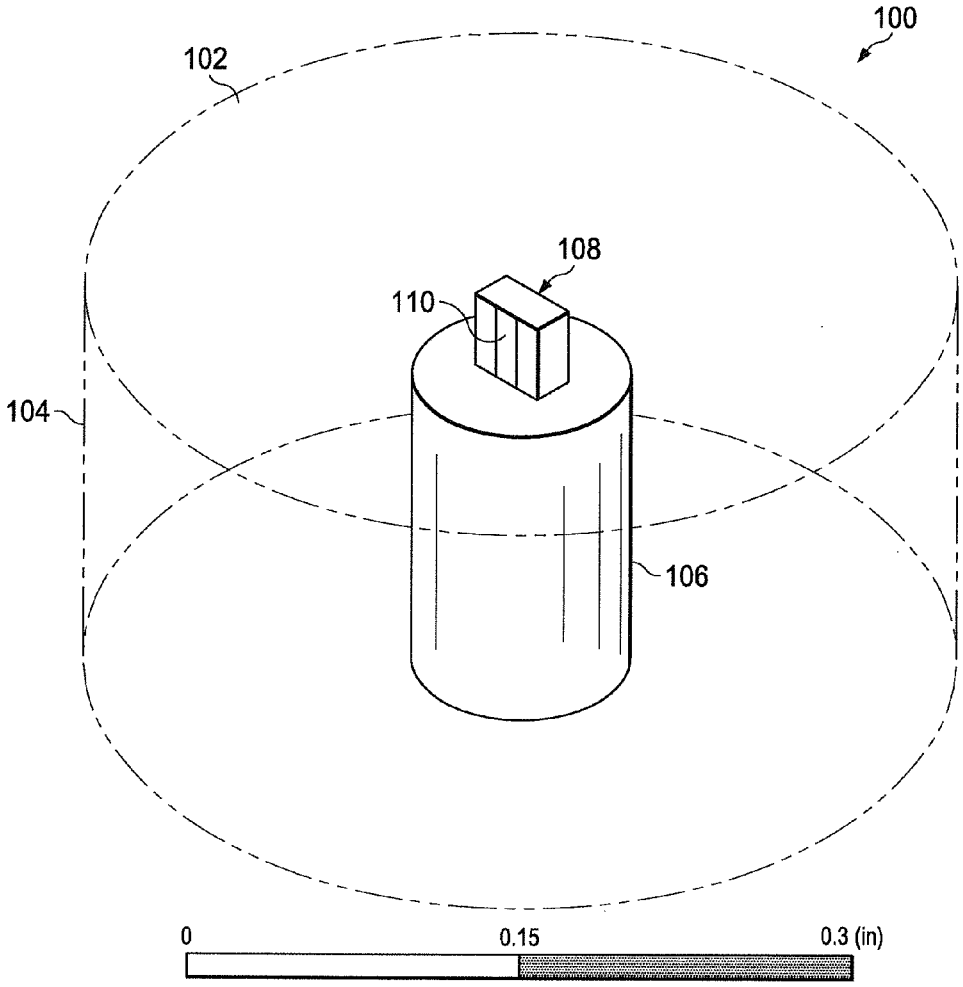
FIGS. 1A and 1B illustrate an example cavity filter according to embodiments of the present disclosure.
Figure 1B:
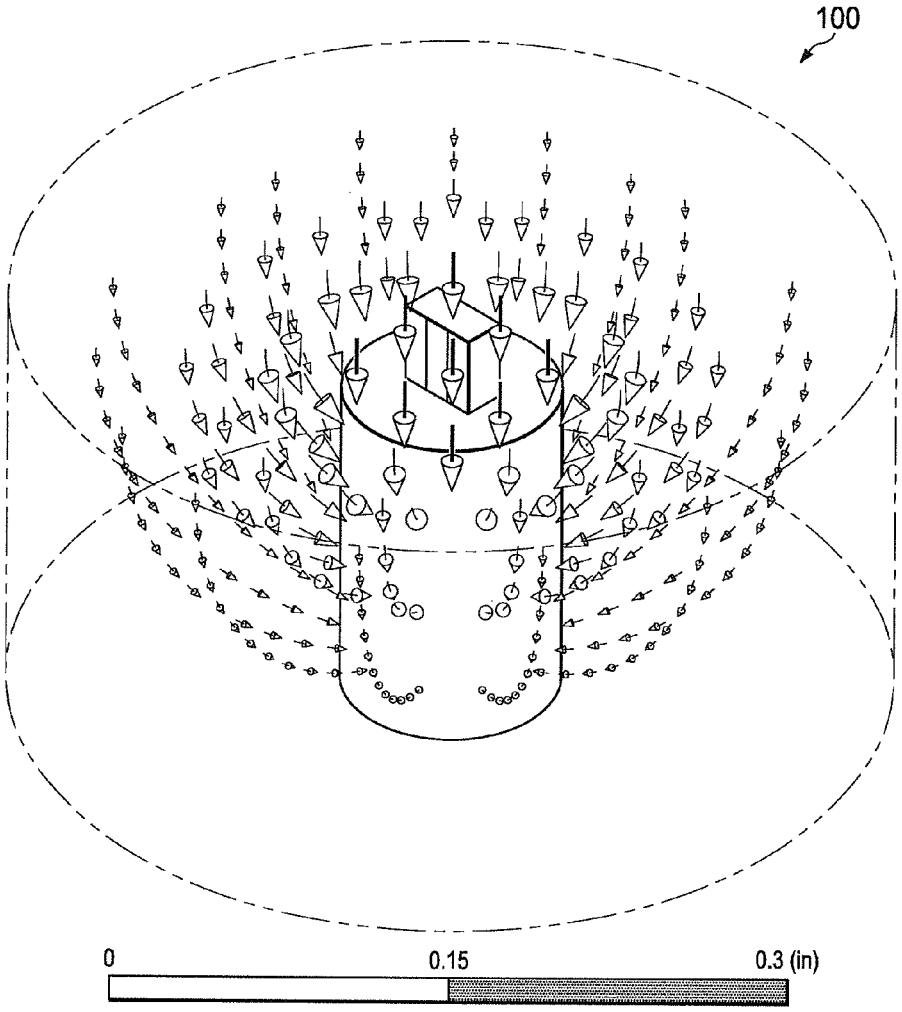

FIGS. 1A and 1B illustrate an example cavity filter according to embodiments of the present disclosure. FIG. 1A illustrates a cavity filter 100 when a cavity 102 is not energized and FIG. 1B illustrates cavity filter 100 when the cavity 102 is energized in a coaxial mode. The embodiment of the cavity filter shown in FIGS. 1A and 1B are for illustration only. Other embodiments of a cavity filter could be used without departing from the scope of this disclosure.

The cavity filter 100 is a coaxial resonator including a cavity 102, a wall 104, a resonator post 106, a PCB 108, and a tuning circuit 110. The PCB 108 is parallel to the coaxial cylindrical axes of the resonator post 106 and the cylindrical wall 104 at a high EM field within the cavity 102 to provide a wide tuning range. The tuning circuit 110 includes a single path varactor that provides very high quality factor (Q) and is comprised by the PCB 108. In certain embodiments, the tuning circuit 110 includes one or more transistors, capacitors, inductors, and resistors configured as an active capacitor circuit with a negative ESR that compensates for additional lossy interconnects or circuits connected to the cavity filter 100. This loss compensation results in high Q resonators and low insertion loss cavity filters with its appropriate technology in the frequency range of interest. This approach is also beneficial for higher frequency applications such as mmWave and E-band ranges where conductive losses are significantly larger than those of lower frequencies. With appropriate dimensions and tuning, a resonant frequency of the cavity filter 100 can include 8.09253 GHz and/or 6.24867 GHz.

The cavity 102 is configured to receive EM waves. The tuning circuits 110 are disposed proximate to the cavity 102, and in the cavity 102 as shown. The tuning circuits 110 and the cavity 102 are configured to filter the EM waves.

Figure 2B:
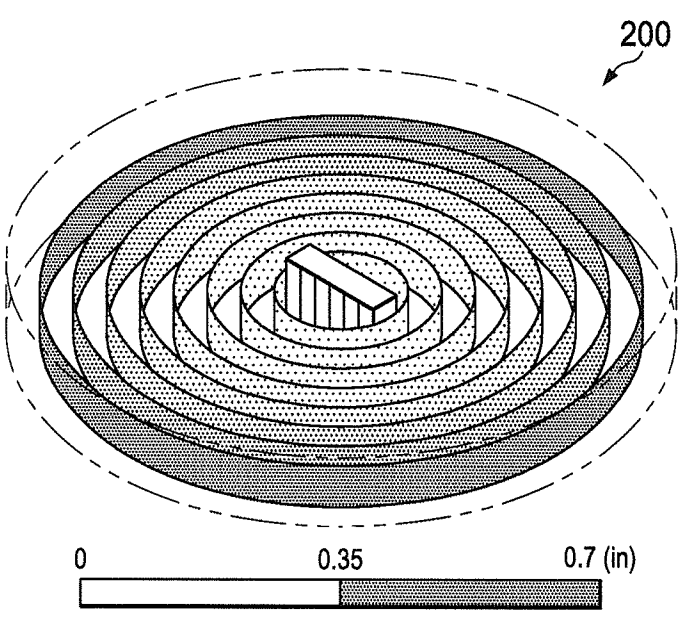
FIGS. 2A and 2B illustrate an example cavity filter according to embodiments of the present disclosure.
Figure 2A:
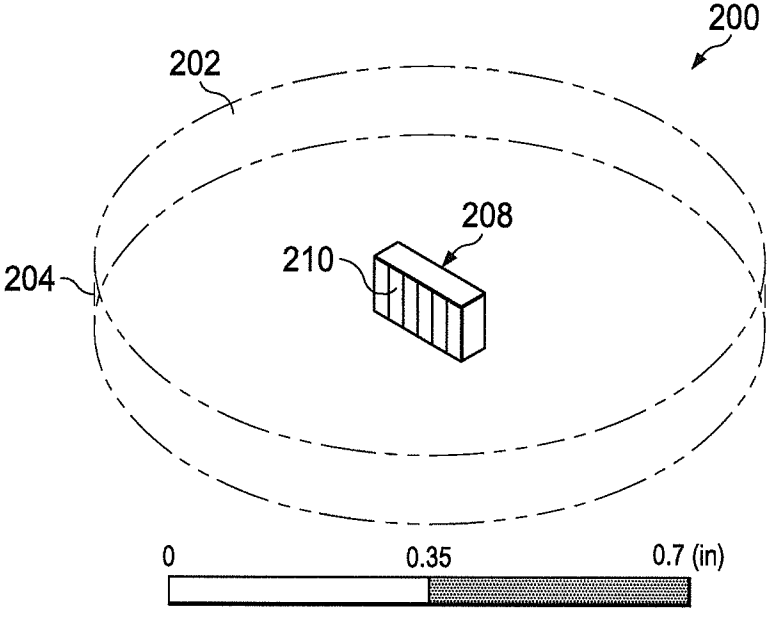

FIGS. 2A and 2B illustrate an example cavity filter according to embodiments of the present disclosure. FIG. 2A illustrates a cavity filter 200 when a cavity 202 is not energized and FIG. 2B illustrates cavity filter 200 when the cavity 202 is energized in a transverse magnetic mode. The embodiment of the cavity filter shown in FIGS. 2A and 2B is for illustration only. Other embodiments of a cavity filter could be used without departing from the scope of this disclosure.

The cavity filter 200 is a coaxial resonator including the cavity 202, a wall 204, a PCB 208, and tuning circuit 210. The PCB 208 is parallel to the coaxial cylindrical axis of the cylindrical wall 204 at a high EM field within the cavity 202 to provide a wide tuning range. The tuning circuit 210 includes one or more active switches to switch between multiple tuning circuits, such as one or more varactors. In certain embodiments, the tuning circuit 210 includes one or more active capacitor circuits that each include one or more transistors, capacitors, inductors, and resistors to form a negative ESR to compensate for additional lossy interconnects or circuits connected to the cavity filter 200.

The cavity 202 and the tuning circuit 210 are dimensioned and designed for resonance in a transverse magnetic (TM) mode, specifically, the TM010 mode, which advantageously allows for reducing a dimension of the cavity 202, such as the height of the cavity 202. The very small height of the cavity 202 allows for miniature cavities for higher frequencies. With appropriate dimensions and tuning, a resonant frequency of the cavity filter 100 can include 7.32149 GHz with a Q of 2995.31 and/or 6.66634 GHz with a Q of 43050.6.

Figure 3A:
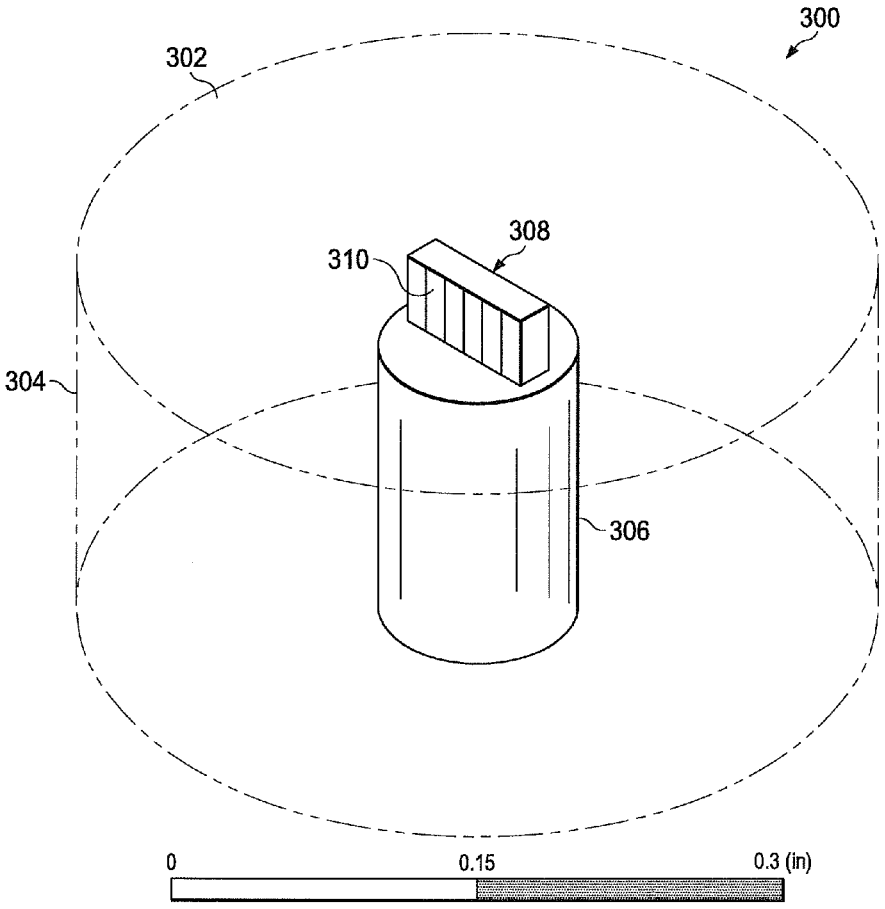
FIGS. 3A and 3B illustrate an example cavity filter according to embodiments of the present disclosure.
Figure 3B:
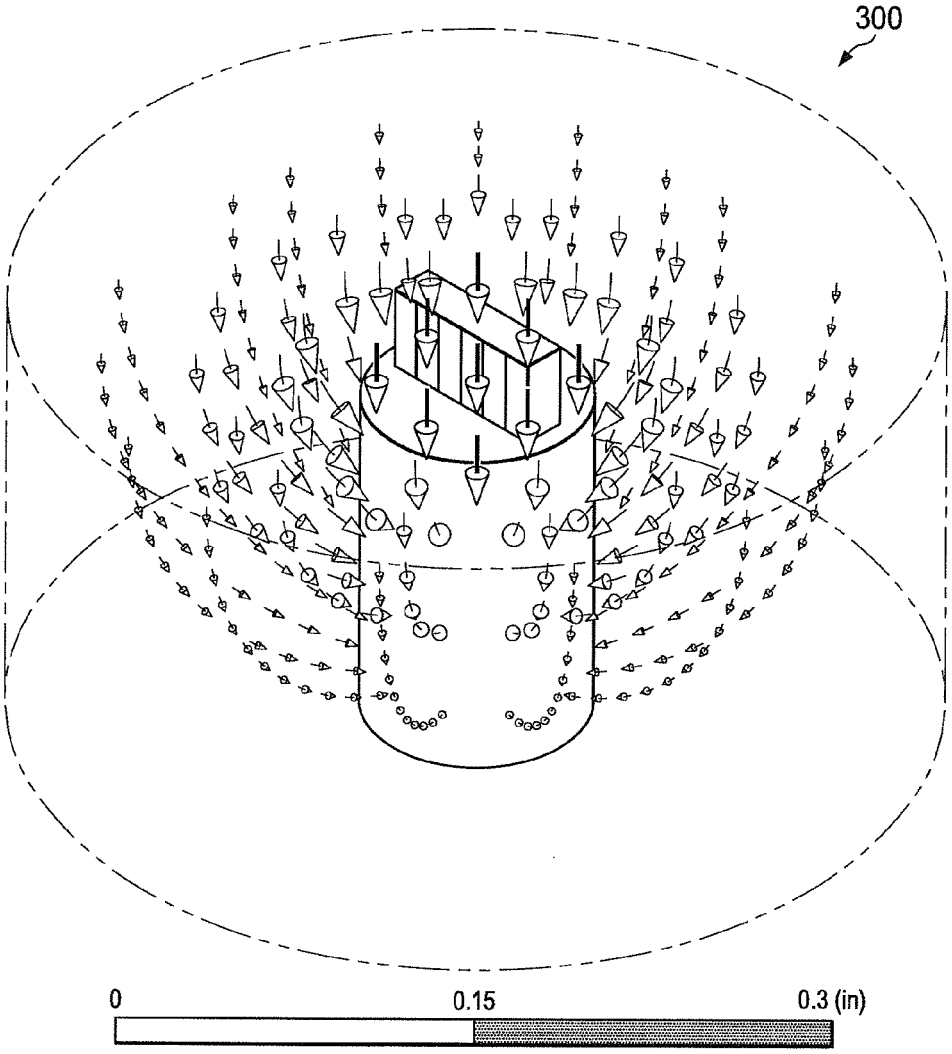

FIGS. 3A and 3B illustrate an example cavity filter according to embodiments of the present disclosure. FIG. 3A illustrates the cavity filter 300 when a cavity 302 is not energized and FIG. 3B illustrates cavity filter 300 when the cavity 302 is energized in a coaxial mode. The embodiment of the cavity filter shown in FIGS. 3A and 3B are for illustration only. Other embodiments of a cavity filter could be used without departing from the scope of this disclosure.

The cavity filter 300 is a coaxial resonator including the cavity 302, a wall 304, a resonator post 306, a PCB 308, and tuning circuit 310. The PCB 308 is parallel to the coaxial cylindrical axes of the resonator post 306 and the cylindrical wall 304 at a high EM field within the cavity 302 to provide a wide tuning range. The tuning circuit 310 includes one or more active switches to switch between multiple tuning circuits, such as one or more varactors. In certain embodiments, the tuning circuit 310 includes one or more active capacitor circuits that each include one or more transistors, capacitors, inductors, and resistors to form a negative ESR to compensate for lossy interconnects or circuits connected to the cavity filter 300. With appropriate dimensions and tuning, a resonant frequency of the cavity filter 100 can include 8.20619 GHz with a Q of 4003.23 and/or 6.64164 GHz with a Q of 55330.9.

Figure 4:
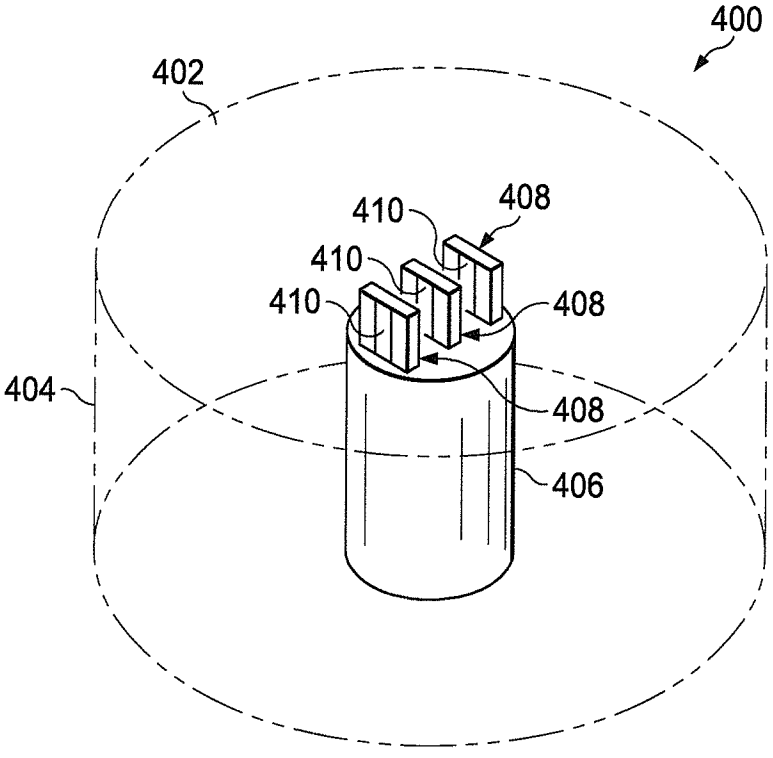
FIG. 4 illustrates an example cavity filter according to embodiments of the present disclosure.

FIG. 4 illustrates an example cavity filter according to embodiments of the present disclosure. The embodiment of the cavity filter shown in FIG. 4 is for illustration only. Other embodiments of a cavity filter could be used without departing from the scope of this disclosure.

The cavity filter 400 is a coaxial resonator including a cavity 402, a wall 404, a resonator post 406, multiple PCBs 408, and tuning circuits 410. The PCBs 408 are parallel to the coaxial cylindrical axes of the resonator post 406 and the cylindrical wall 404 at a high EM field within the cavity 402 to provide a wide tuning range. Each PCB 408 includes at least one tuning circuit 410. In certain embodiments, the tuning circuits 410 include one or more active capacitor circuits that each include one or more transistors, capacitors, inductors, and resistors to form negative ESRs that compensate for lossy interconnects or circuits connected to the cavity filter. In certain embodiments, resonator post 406 is rectangular or circular.

Figure 5:
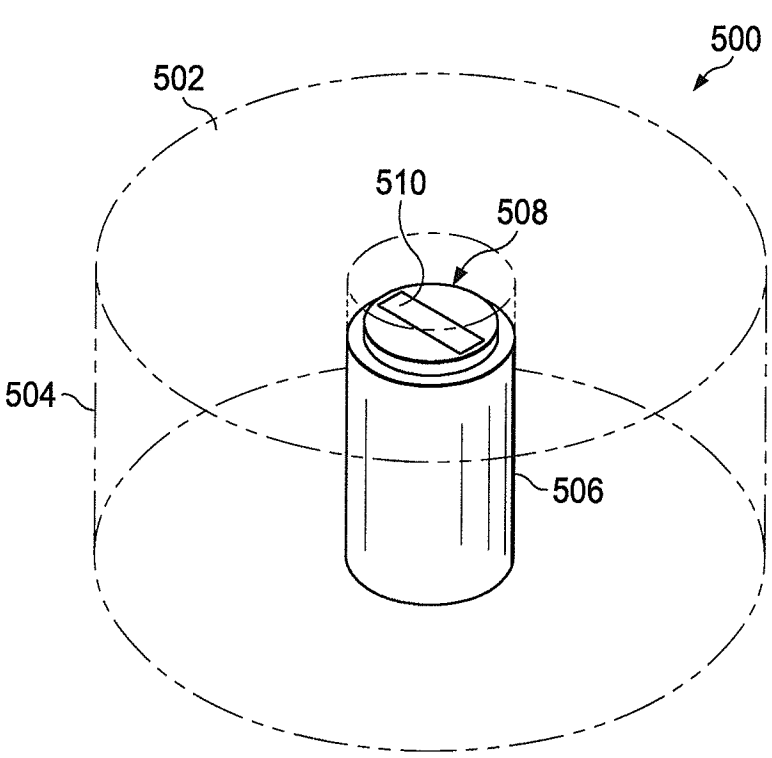
FIG. 5 illustrates an example cavity filter according to embodiments of the present disclosure.

FIG. 5 illustrates an example cavity filter according to embodiments of the present disclosure. The embodiment of the cavity filter shown in FIG. 5 is for illustration only. Other embodiments of a cavity filter could be used without departing from the scope of this disclosure.

The cavity filter 500 is a coaxial resonator including a cavity 502, a wall 504, a resonator post 506, a PCB 508, and a tuning circuit 510. The PCB 508 is perpendicular to the coaxial cylindrical axes of the resonator post 506 and the cylindrical wall 504. The PCB 508 is within a hollowed out portion of the resonator post 506. The PCB 508 is horizontal with respect to the vertical axes of the resonator post 506 and the cylindrical wall 504. The PCB 508 includes the tuning circuit 510. In certain embodiments, the tuning circuit 510 includes one or more active capacitor circuits that each include one or more transistors, capacitors, inductors, and resistors to form a negative ESR that compensates for lossy interconnects or circuits connected to the cavity filter. In certain embodiments, resonator post 506 is rectangular or circular.

Figure 6:
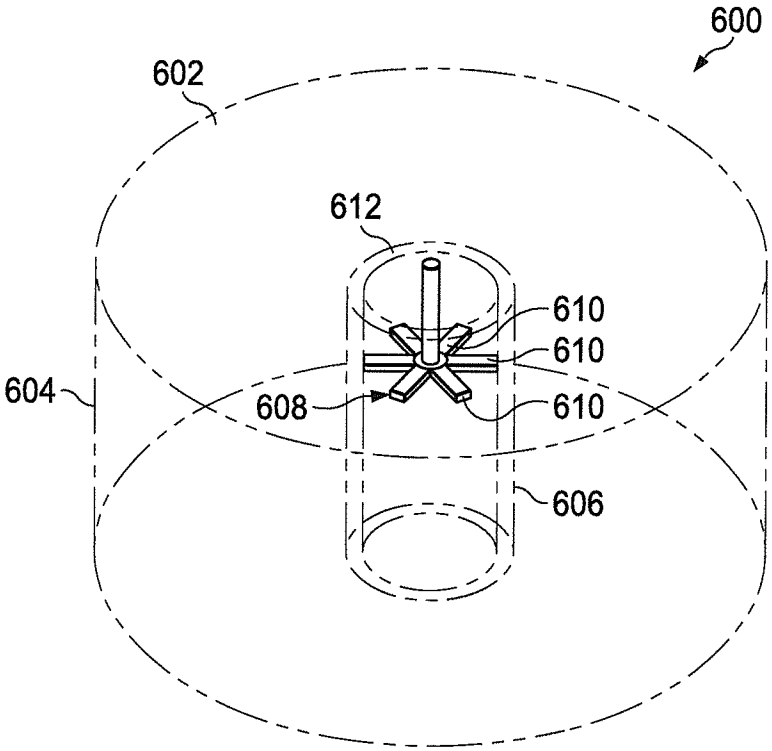
FIG. 6 illustrates an example cavity filter according to embodiments of the present disclosure.

FIG. 6 illustrates an example cavity filter according to embodiments of the present disclosure. The embodiment of the cavity filter shown in FIG. 6 is for illustration only. Other embodiments of a cavity filter could be used without departing from the scope of this disclosure.

The cavity filter 600 is a coaxial resonator including a cavity 602, a wall 604, a resonator post 606, a PCB 608, tuning circuits 610, and a hollowed out portion 612 of the resonator post 606. The PCB 608 is perpendicular to the coaxial cylindrical axes of the resonator post 606 and the cylindrical wall 604. The PCB 608 is horizontal with respect to the vertical axes of the resonator post 606 and the cylindrical wall 604. The PCB 608 includes tuning circuits 610. The resonator post 606 includes the hollowed out portion 612. In certain embodiments, the tuning circuits 610 include one or more active capacitor circuits that each include one or more transistors, capacitors, inductors, and resistors to form a negative ESR that compensates for lossy interconnects or circuits connected to the cavity filter.

Figure 7:
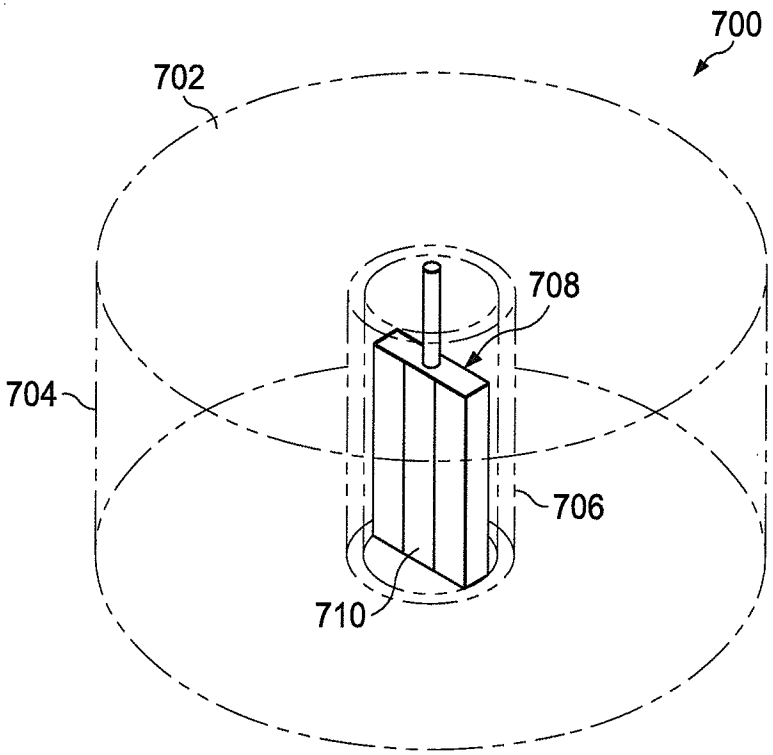
FIG. 7 illustrates an example cavity filter according to embodiments of the present disclosure.

FIG. 7 illustrates an example cavity filter according to embodiments of the present disclosure. The embodiment of the cavity filter shown in FIG. 7 is for illustration only. Other embodiments of a cavity filter could be used without departing from the scope of this disclosure.

The cavity filter 700 is a coaxial resonator including a cavity 702, a wall 704, a resonator post 706, a PCB 708, and at least one tuning circuit. The PCB 708 is parallel to the coaxial cylindrical axes of the resonator post 706 and the cylindrical wall 704. The PCB 708 is mounted coaxially to the resonator post 706 and is surrounded by the metal of the resonator post 706. Bias circuitry that includes the at least one tuning circuit can come out safely from the bottom of the cavity filter 700 without interfering with the EM field of the cavity 702. In certain embodiments, the tuning circuit 710 includes one or more active capacitor circuits that each include one or more transistors, capacitors, inductors, and resistors to form a negative ESR that compensates for lossy interconnects or circuits connected to the cavity filter.

FIGS. 8A through 8D illustrate an example cavity filter according to embodiments of the present disclosure. The embodiment of the cavity filter shown in FIGS. 8A through 8D is for illustration only. Other embodiments of a cavity filter could be used without departing from the scope of this disclosure.

The cavity filter 800 is a coaxial resonator including a cavity 802, a wall 804, a PCB 808, and a tuning circuit 810. The PCB 808 is parallel to the coaxial cylindrical axis of the cylindrical wall 804 at a high EM field within the cavity 802 to provide a wide tuning range. The wall 804 includes two notches 814 that provide for the placement of the PCB 808 and ease of assembly and manufacturing. The PCB 808 is slidably positioned within the cavity 802. The at least one tuning circuit 810 is designed to be electronically tunable and change the EM field inside the cavity 802 so as to tune the cavity filter 800. Certain embodiments include active circuitry to enhance the Q of the cavity filter 800.

Figure 8B:
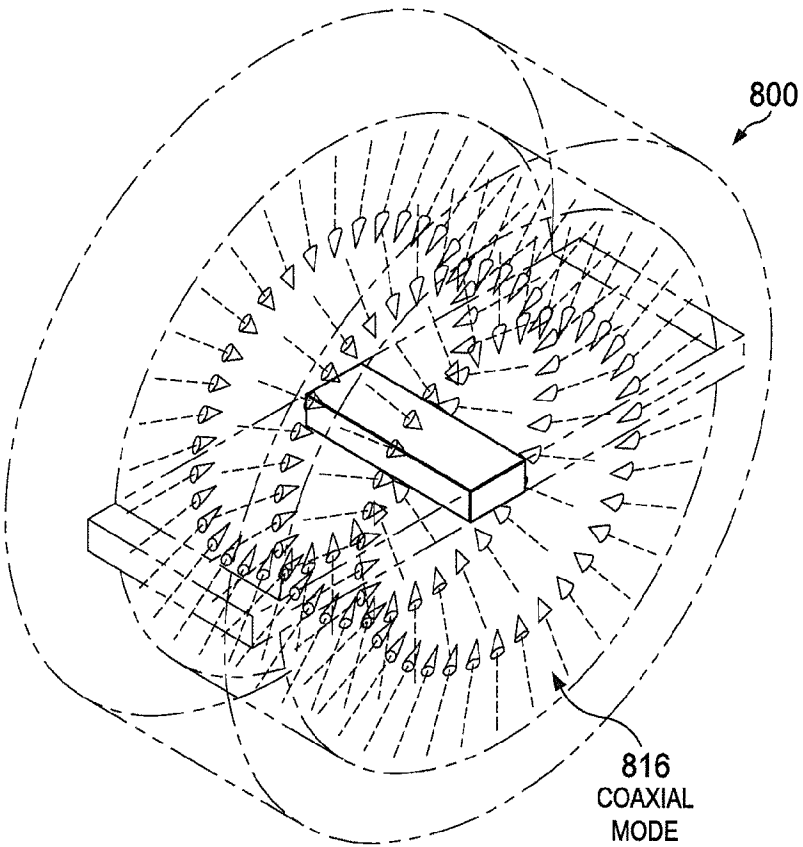
FIGS. 8A through 8D illustrate an example cavity filter according to embodiments of the present disclosure.
Figure 8A:
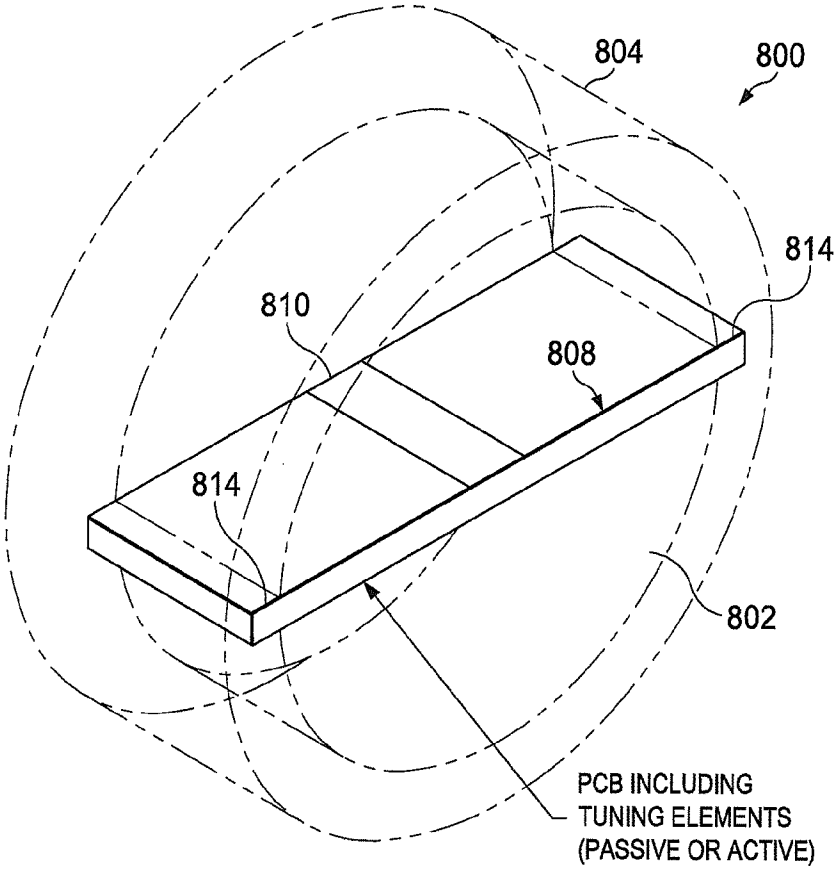
Figure 8D:
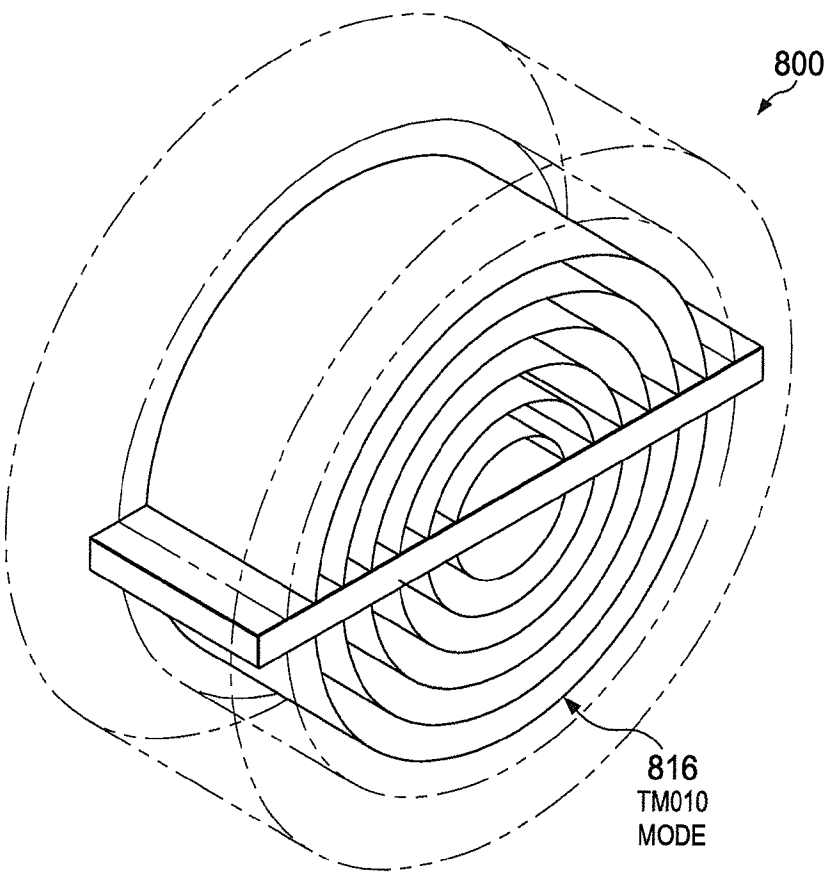
Figure 8C:
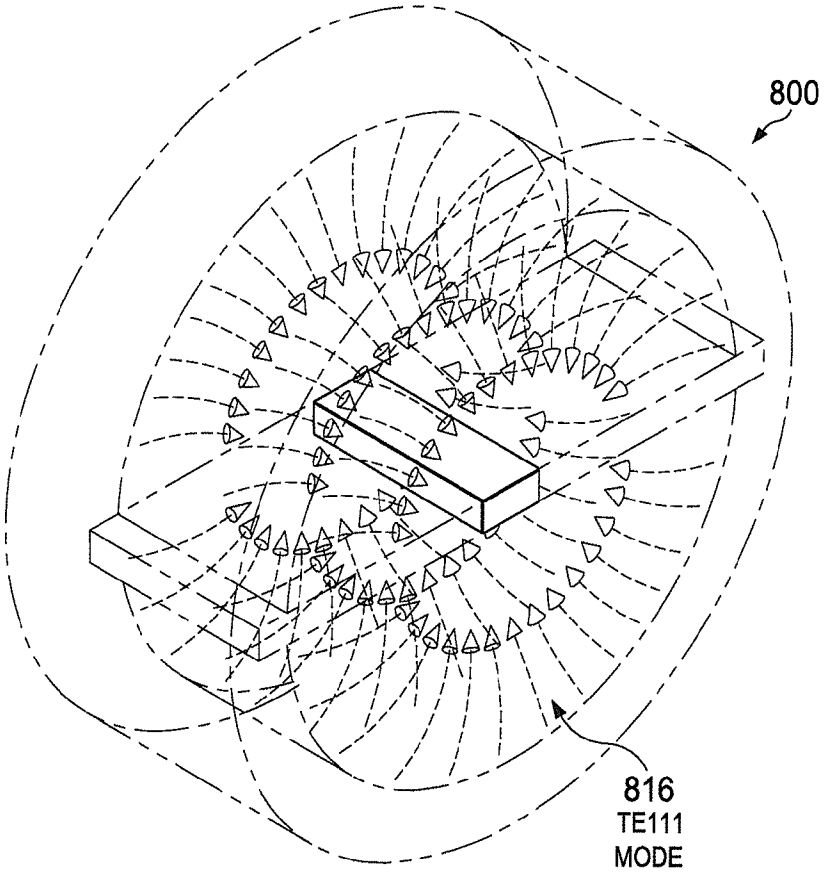

FIG. 8A illustrates the cavity filter 800 when EM fields are not excited. FIG. 8B illustrates the cavity filter 800 when EM fields 816 are excited in a coaxial mode via the tuning circuit 810. FIG. 8C illustrates the cavity filter 800 when EM fields 816 are excited in a transverse electric (TE) mode, e.g., TE111, via the tuning circuit 810. FIG. 8D illustrates the cavity filter 800 when EM fields 816 are excited in a transverse magnetic (TM) mode, e.g., TM010, via the tuning circuit 810. Tuning circuitry on the PCB 808, including the tunable circuit 810, is designed based on the mode of resonance to provide best tunability and Q of the cavity filter 800. The cavity filter 800 is free of spurious resonators in one or more modes, including the TM010 mode. Certain embodiments exploit a negative ESR capacitor and the negative ESR can be absorbed via additional lossy interconnects or circuits.

Figure 9B:
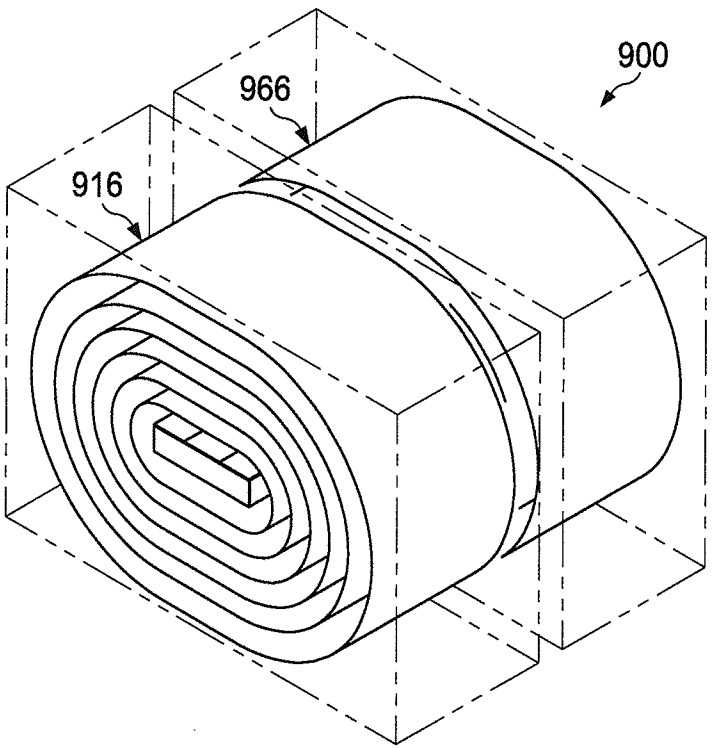
FIGS. 9A through 9B illustrate an example cavity filter according to embodiments of the present disclosure.
Figure 9A:
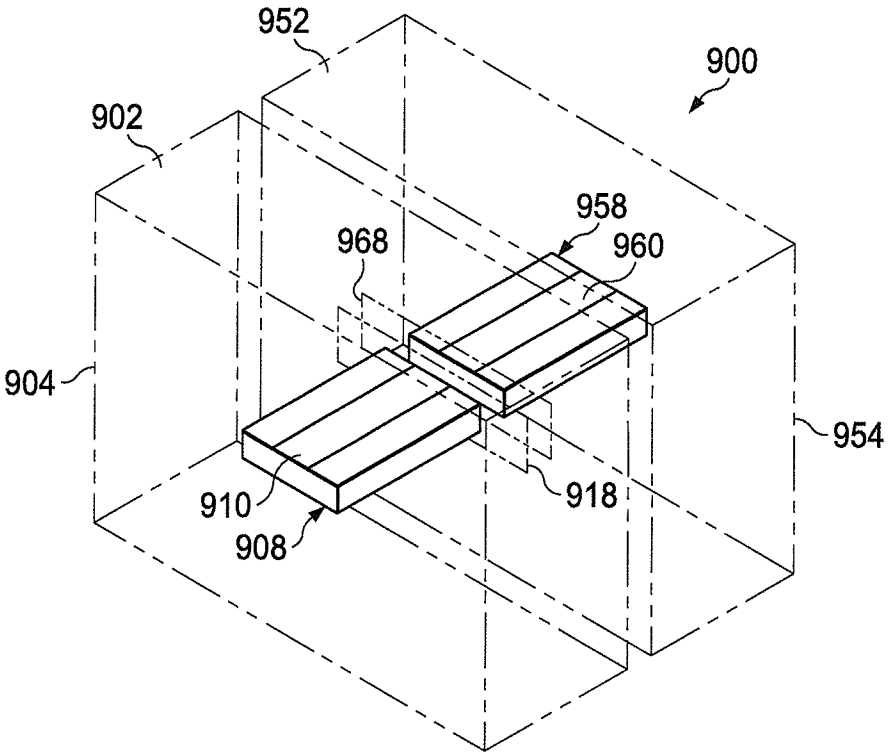

FIGS. 9A through 9B illustrate an example cavity filter according to embodiments of the present disclosure. The embodiment of the cavity filter shown in FIGS. 9A through 9B is for illustration only. Other embodiments of a cavity filter could be used without departing from the scope of this disclosure.

The cavity filter 900 is a two cavity coupled multilayer high frequency active resonator. The cavity filter 900 of FIGS. 9A and 9B includes a first cavity 902, a first wall 904, a first PCB 908, and a first tuning circuit 910. The cavity filter 900 also includes a second cavity 952, a second wall 954, a second PCB 958, and a second tuning circuit 960. The first PCB 908 and the second PCB 958 are parallel to a common axis of the first cavity 902 and the second cavity 952 at a high EM field within the respective cavities 902 and 952 to provide a wide tuning range. The cavity 902 includes a slot 918 and the cavity 952 includes a slot 968 that operate in combination to allow EM fields to resonate between both the first cavity 902 and the second cavity 952. FIG. 9B illustrates the cavity filter 900 when EM fields 916 and 966 are excited in a TM mode via the tuning circuits 910 and 960 respectively. In certain embodiments, the tuning circuits 910 include one or more active capacitor circuits that each include one or more transistors, capacitors, inductors, and resistors to form a negative ESR that compensates for lossy interconnects or circuits connected to the cavity filter. With appropriate dimensions and tuning, a resonant frequency of the cavity filter 900 can include: 90.3777 GHz with a Q of 3930.92; 90.7368 GHz with a Q of 6366.46; 69.5045 GHz with a Q of 3261.75; and/or 69.7039 GHz with a Q of 4092.68.

Figure 10A:
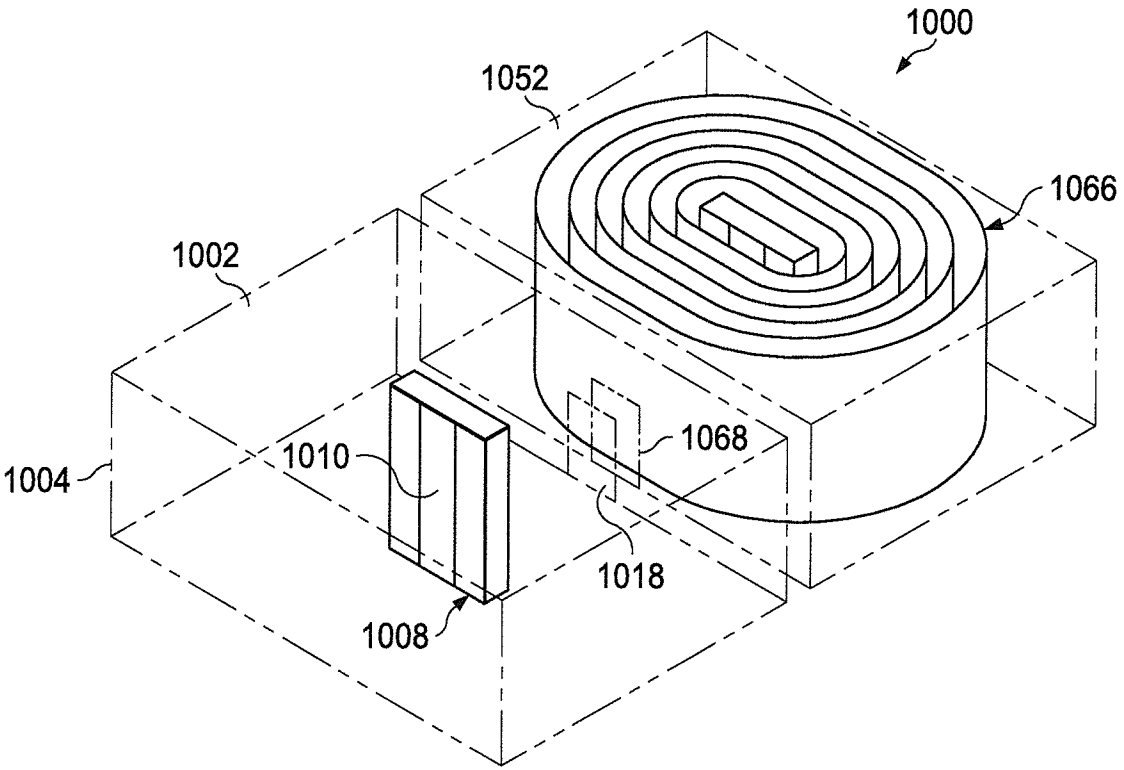
FIGS. 10A through 10B illustrate an example cavity filter according to embodiments of the present disclosure.
Figure 10B:
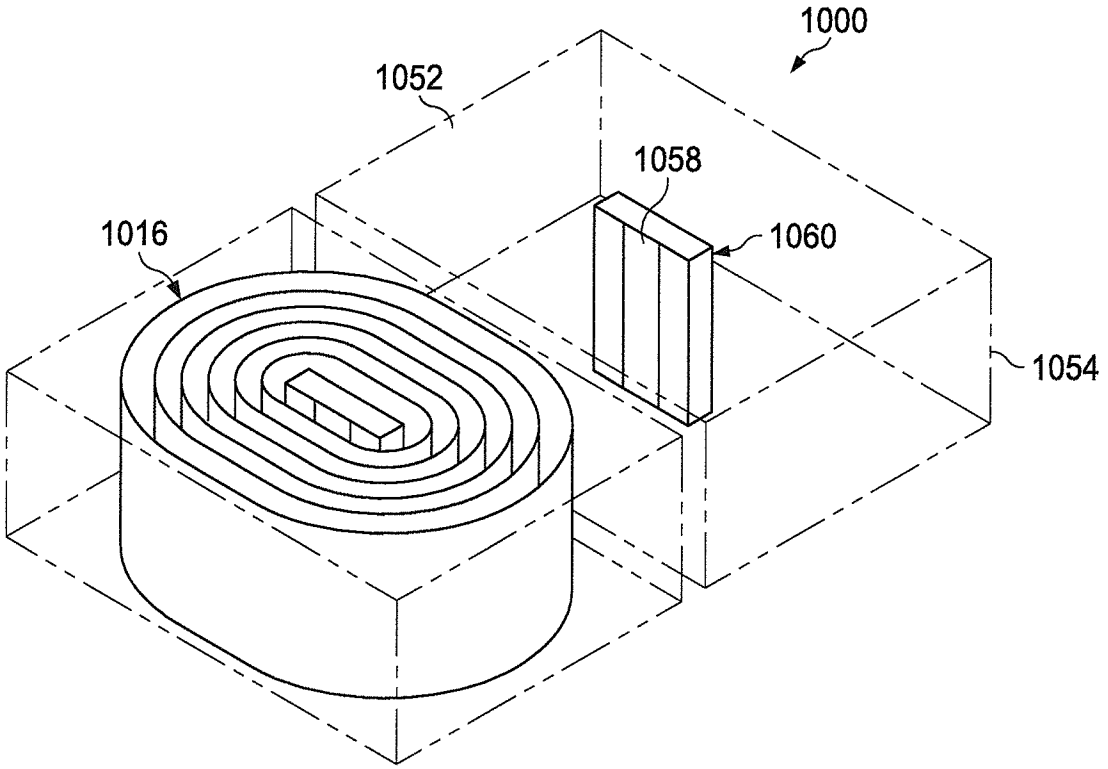

FIGS. 10A through 10B illustrate an example cavity filter according to embodiments of the present disclosure. The embodiment of the cavity filter shown in FIGS. 10A through 10B is for illustration only. Other embodiments of a cavity filter could be used without departing from the scope of this disclosure.

The cavity filter 1000 is a two cavity coupled multilayer high frequency active resonator. The cavity filter 1000 of FIGS. 10A and 10B includes a first cavity 1002, a first wall 1004, a first PCB 1008, and a first tuning circuit 1010. The cavity filter 1000 also includes a second cavity 1052, a second wall 1054, a second PCB 1058, and a second tuning circuit 1060. The first PCB 1008 and the second PCB 1058 are perpendicular to a common axis of the first cavity 1002 and the second cavity 1052 at a high EM field within the respective cavities 1002 and 1052 to provide a wide tuning range. The cavity 1002 includes an opening 1018 and the cavity 1052 includes an opening 1068 that operate in combination to allow EM fields 1016 and 1066 to resonate between both the first cavity 1002 and the second cavity 1052. FIG. 10A illustrates the cavity filter 1000 when the EM fields 1066 are excited in a TM mode via the tuning circuit 1060 in cavity 1052. FIG. 10B illustrates the cavity filter 1000 when the EM fields 1016 are excited in a TM mode via the tuning circuit 1010 in cavity 1002. In certain embodiments, the tuning circuits 1010 include one or more active capacitor circuits that each include one or more transistors, capacitors, inductors, and resistors to form a negative ESR that compensates for lossy interconnects or circuits connected to the cavity filter.

Figure 11A:
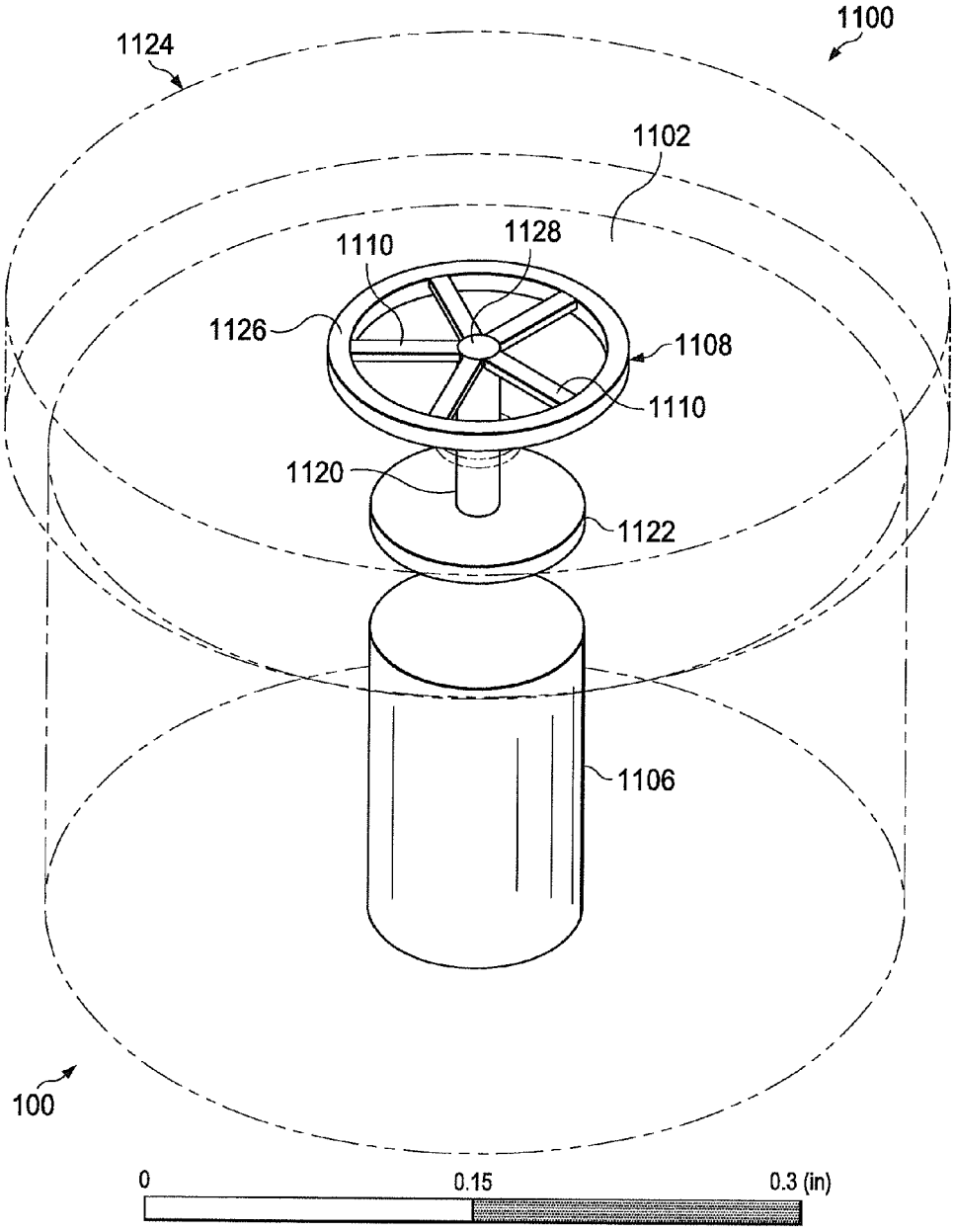
FIGS. 11A through 11B illustrate an example cavity filter according to embodiments of the present disclosure.
Figure 11B:
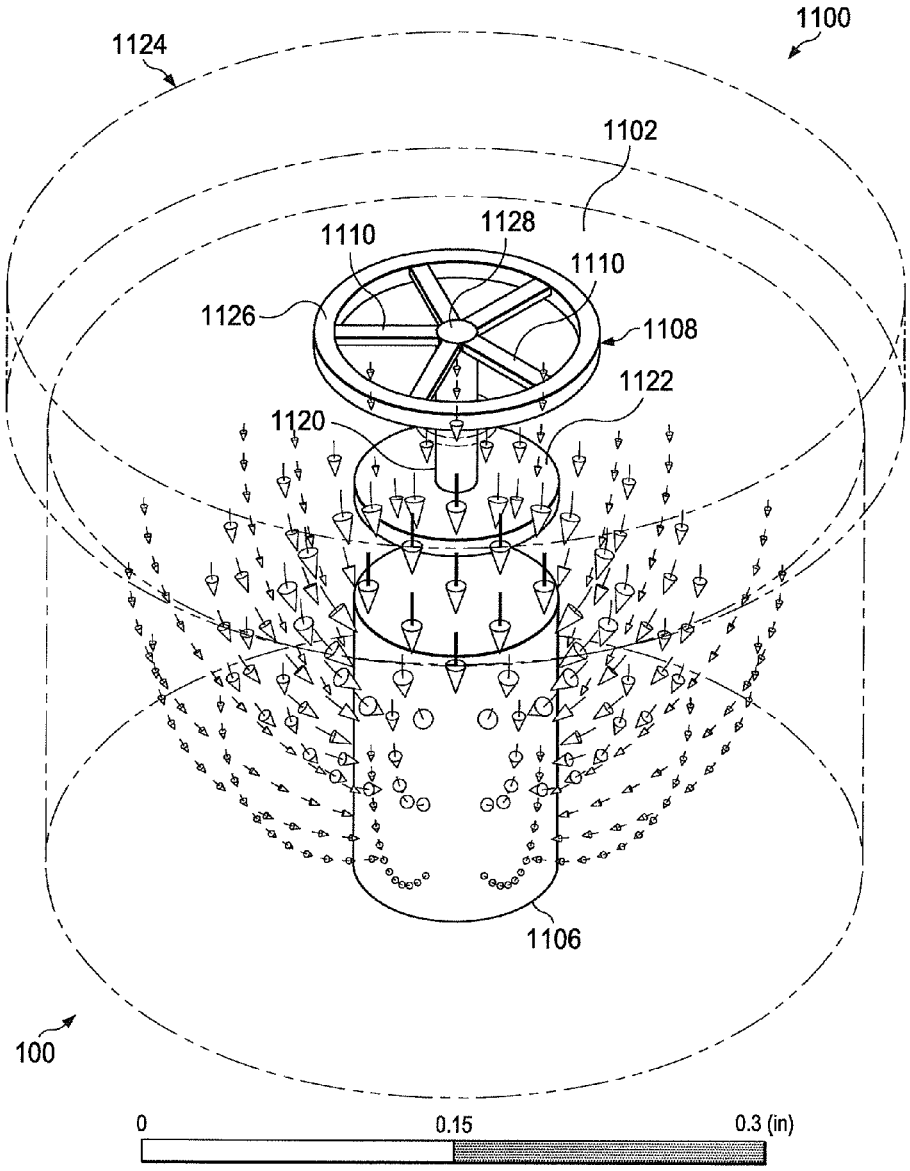

FIGS. 11A through 11B illustrate an example cavity filter according to embodiments of the present disclosure. The embodiment of the cavity filter shown in FIGS. 11A through 11B is for illustration only. Other embodiments of a cavity filter could be used without departing from the scope of this disclosure.

The cavity filter 1100 is coupled to a waveguide 1124 via a screw 1120. The cavity filter 1100 of FIGS. 11A and 11B includes a cavity 1102, a wall 1104, a resonator post 1106, a PCB 1108, tuning circuit 1110, a center pad 1128, and ground pad 1126. The tuning circuit 1110 includes five varactors in a multipath configuration providing a tunable capacitance. The PCB 1108 is perpendicular to the coaxial cylindrical axes of the resonator post 1106 and the cylindrical wall 1104 at a high EM field within the cavity 1102 to provide a wide tuning range. The PCB 1108 is horizontal with respect to the vertical axes of the resonator post 1106 and the cylindrical wall 1104. The cavity 1102 includes an opening through which the screw 1120 extends.

The screw 1120 is coupled to the waveguide 1124 via the PCB 1108, the ground pad 1126, and the center pad 1128. The ground pad 1126 is formed as a circular ring around an edge of the PCB 1108. The electronic tuning circuit 1110 couples the ground pad 1126 to the center pad 1128 with a tunable capacitance between the ground pad 1126 and the center pad 1128. The screw 1120 includes plate 1122 that is maintained at a distance away from the resonator post 1106. Wider tunability is achieved by a smaller gap between the plate 1122 and the resonator post 1106. EM waves from the waveguide 1124 excite the screw 1120, are filtered or otherwise transferred via the tuning circuit 1110, and excite the plate 1122, which excites the cavity 1102. A radius and diameter of the plate 1122 is substantially similar to a radius and diameter of the resonator post 1106. The radius and diameter of the plate 1122 is substantially similar to a radius and diameter of the PCB 1108. The ground pad 1126 is connected to a wall of the waveguide 1124 and the center pad 1126 is connected via the tuning circuit 1110 to the ground pad 1124. With appropriate dimensions and the tuning circuit 1110 providing a capacitance of 0.04 pF at each of the five varactors, a resonant frequency of the cavity filter can include 7.73670 GHz with a Q of 2350.62. With appropriate dimensions and the tuning circuit 1110 providing a capacitance of 0.4 pF at each of the five varactors, a resonant frequency of the cavity filter can include 7.43158 GHz with a Q of 1820.00. With appropriate dimensions and the tuning circuit 1110 providing a capacitance of 1 picofarad (pF) at each of the five varactors, a resonant frequency of the cavity filter can include 7.32283 GHz with a Q of 1612.77.

Figure 12:
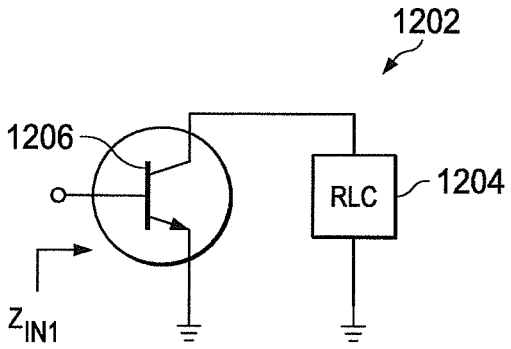
FIG. 12 illustrates a tuning circuit including an active capacitor according to embodiments of the present disclosure.

FIG. 12 illustrates a tuning circuit including an active capacitor according to embodiments of the present disclosure. The embodiment of the tuning circuit shown in FIG. 12 is for illustration only. Other embodiments of a tuning circuit could be used without departing from the scope of this disclosure.

The tuning circuit 1202 includes RLC elements 1204 and transistor 1206. The RLC elements 1204 include one or more resister, inductor, and capacitor elements connected in series and/or parallel. The transistor 1206 is shown as a bipolar junction transistor (BJT), but any appropriate type of transistor can be used. The transistor 1206 and the RLC elements 1204 are selected so that when combined, the circuit 1202 functions as if there were a negative series resistance. The tuning circuit 1202 can be embodied and included within the tuning circuit 110 of FIG. 1, the tuning circuit 210 of FIG. 2, the tuning circuit 310 of FIG. 3, the tuning circuit 410 of FIG. 4, the tuning circuit 510 of FIG. 5, the tuning circuit 610 of FIG. 6, the tuning circuit 710 of FIG. 7, the tuning circuit 810 of FIG. 8, the tuning circuits 910 and 960 of FIG. 9, the tuning circuits 1010 and 1060 of FIG. 10, and the tuning circuit 1110 of FIG. 11.

Figure 13:
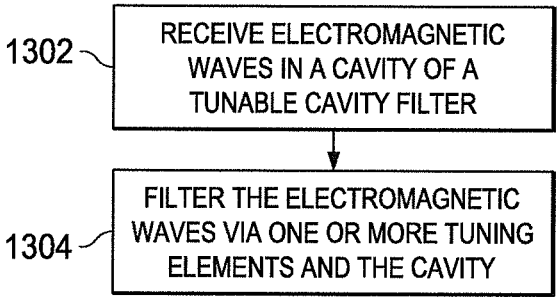
FIG. 13 illustrates a flowchart for filtering EM waves according to embodiments of the present disclosure.

FIG. 13 illustrates a flowchart for filtering EM waves according to embodiments of the present disclosure. While the flowchart depicts a series of sequential steps, the scope of the present disclosure is not limited to the sequence depicted and described. The steps can be performed in a different order, with additional, intervening, or intermediate steps, and without steps that have been depicted. The process depicted in the example is implemented by any suitably configured filter, such as the cavity filters 100-1100 of FIGS. 1 through 13

At step 1302, a cavity of a tunable cavity filter receives EM waves. The EM waves are received from a waveguide coupled to the cavity filter.

At step 1304, the EM waves are filtered via one or more tuning circuits disposed proximate to the cavity and via the cavity. The resonant frequency and Q of the cavity filter are based on the dimensions of the cavity and the resistance, inductance, and capacitance provided by the tuning circuits. A PCB includes the one or more tuning circuits, includes a substrate, and provides for placement of the tuning circuits within the cavity. The PCB is placed substantially parallel or substantially perpendicular to an axis of the cavity of the cavity filter and is slidably positioned within the cavity filter. In certain embodiments, the PCB and the cavity are configured to be substantially free of spurious resonators in a transverse magnetic mode of the electromagnetic waves. The filtering of the EM waves is electronically tunable.

Certain embodiments in accordance with the present disclosure have the cavity filter configured as one of a coaxial resonator, a waveguide resonator, a dielectric resonator, a substrate integrated waveguide (SIW) resonator, and a stepped impedance resonator (SIR). The cavity and the tuning circuits are configured to create a negative equivalent series resistance capacitor and/or a negative equivalent series resistance inductor.

Certain embodiments in accordance with the present disclosure have the cavity filter as a high Q cavity resonator with tuning circuits combined with lossy circuits for Q compensation. The circuits include microelectromechanical system (MEMS) switches.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An apparatus for filtering electromagnetic waves, the apparatus comprising:

a cavity for receiving the electromagnetic waves and having a resonant frequency; and one or more tuning circuits disposed at a resonator center axis of the cavity, wherein the one or more tuning circuits and the cavity filter the electromagnetic waves, and wherein the resonant frequency of the cavity is based on the one or more tuning circuits, wherein each of the one or more tuning circuits comprises:

a transistor and one or more of a resistor, inductor or capacitor, creating a negative equivalent series resistance (ESR).

2. The apparatus in accordance with claim 1, further comprising:

a printed circuit board (PCB) comprising the one or more tuning circuits.

3. The apparatus in accordance with claim 2, wherein the PCB is disposed one of substantially parallel or substantially perpendicular to an axis of the cavity.

4. The apparatus in accordance with claim 3, wherein the PCB is slidably positioned within the cavity.

5. The apparatus in accordance with claim 2, wherein the PCB and the cavity are substantially free of spurious resonators in a transverse magnetic mode of the electromagnetic waves.

6. The apparatus in accordance with claim 2, wherein the PCB is positioned at a high electromagnetic (EM) field location within the cavity.

7. The apparatus in accordance with claim 1, wherein the apparatus is one of a coaxial resonator, a waveguide resonator, a dielectric resonator, a substrate integrated waveguide (SIW) resonator, or a stepped impedance resonator (SIR).

8. The apparatus in accordance with claim 1, wherein the apparatus is a high quality (Q) cavity resonator, and the one or more tuning circuits are combined with one or more lossy circuits to provide Q compensation.

9. The apparatus in accordance with claim 8, wherein the one or more lossy circuits comprises one or more microelectromechanical system (MEMS) switches.

10. The apparatus in accordance with claim 1, wherein the filtering of the electromagnetic waves is electronically tunable, and the one or more tuning circuits comprise active components.

11. A method of operating a tunable cavity filter, the method comprising:

receiving electromagnetic waves in a cavity of the tunable cavity filter; and filtering the electromagnetic waves via one or more tuning circuits and the cavity, wherein the one or more tuning circuits are disposed at a resonator center axis of the cavity of the tunable cavity filter, and wherein the cavity has a resonant frequency based on the one or more tuning circuits, wherein each of the one or more tuning circuits comprises:

a transistor and one or more of a resistor, inductor or capacitor, creating a negative equivalent series resistance (ESR).

12. The method in accordance with claim 11, further comprising:

a printed circuit board (PCB) comprising the one or more tuning circuits.

13. The method in accordance with claim 12, wherein the PCB is disposed one of substantially parallel or substantially perpendicular to an axis of the cavity.

14. The method in accordance with claim 13, wherein the PCB is slidably positioned within the cavity.

15. The method in accordance with claim 12, wherein the PCB and the cavity are substantially free of spurious resonators in a transverse magnetic mode of the electromagnetic waves.

16. The method in accordance with claim 12, wherein the PCB is positioned at a high electromagnetic (EM) field location within the cavity.

17. The method in accordance with claim 11, wherein the tunable cavity filter is one of a coaxial resonator, a waveguide resonator, a dielectric resonator, a substrate integrated waveguide (SIW) resonator, or a stepped impedance resonator (SIR).

18. The method in accordance with claim 11, wherein the tunable cavity filter is a high quality (Q) cavity resonator, and the one or more tuning circuits are combined with one or more lossy circuits and provide Q compensation.

19. The method in accordance with claim 18, wherein the one or more lossy circuits comprise one or more microelectromechanical system (MEMS) switches.

20. The method in accordance with claim 11, wherein the filtering of the electromagnetic waves is electronically tunable, and the one or more tuning circuits comprise active components.

21. A printed circuit board (PCB) for filtering electromagnetic waves in a cavity at a resonant frequency, the PCB comprising:

one or more tuning circuits disposed at a resonator center axis of the cavity, wherein the one or more tuning circuits and the cavity filter the electromagnetic waves in the cavity at the resonant frequency, wherein each of the one or more tuning circuits comprises:

a transistor and one or more of a resistor, inductor or capacitor, creating a negative equivalent series resistance (ESR).

22. The PCB in accordance with claim 21, wherein the one or more tuning circuits include active components.

23. The PCB in accordance with claim 22, wherein the PCB is disposed in the cavity and is one of substantially parallel or substantially perpendicular to an axis of the cavity.

24. The PCB in accordance with claim 23, wherein the PCB is slidably positioned within the cavity.

25. The PCB in accordance with claim 22, wherein the PCB is substantially free of spurious resonators in a transverse magnetic mode of the electromagnetic waves.

26. The PCB in accordance with claim 21, wherein the PCB is positioned in a high electromagnetic (EM) field location within the cavity.

27. The PCB in accordance with claim 21, wherein the PCB is disposed in the cavity of one of a coaxial resonator, a waveguide resonator, a dielectric resonator, a substrate integrated waveguide (SIW) resonator, or a stepped impedance resonator (SIR).

28. The PCB in accordance with claim 21, further comprising:

one or more lossy circuits, wherein the one or more lossy circuits and the one or more tuning circuits are disposed in the cavity and provide Q compensation.

29. The PCB in accordance with claim 28, wherein the one or more lossy circuits comprise one or more microelectromechanical system (MEMS) switches.

30. The PCB in accordance with claim 22, wherein the active components are electronically tunable.

* * * * *